US005136530A

United States Patent [19]

Li et al.

[11] Patent Number: 5,136,530

[45] Date of Patent: Aug. 4, 1992

[54] ULTRAFAST DIGITAL OPTICAL SIGNAL PROCESSING USING A VENN DIAGRAM BASED SPATIAL ENCODING TECHNIQUE

[76] Inventors: Yao Li, 3605 Sedgwick Ave.; Roger Dorsinville, 3915 Orloff Ave., Apt. 3C, both of New York; Robert R. Alfano, 3777 Independence Ave., Bronx, all of N.Y. 10463

[21] Appl. No.: 559,122

[22] Filed: Jul. 26, 1990

[51] Int. Cl.[5] ..... G06E 1/04

[52] U.S. Cl. ..... 364/713

[58] Field of Search ..... 364/713

[56] References Cited

U.S. PATENT DOCUMENTS 4,042,814 8/1977 Taylor ..... 364/713

4,351,589 9/1982 Chavel et al. ..... 364/713

4,918,635 4/1990 Li et al. ..... 364/713

*Primary Examiner*—David H. Malzahn

*Attorney, Agent, or Firm*—Kriesman & Kriegsman

[57] ABSTRACT

An ultrafast digital optical signal processor includes a body of a third order nonlinear material and three input beams, two beams counterproprogating in the material on-axis and the third beam propagating off-axis, all simultaneously, to generate an output beam that counterpropogates with respect to the off-axis input beams. A set of three voltage controlled spatial light modulators are used for encoding the three input beams in accordance with a three-set Venn diagram based encoding scheme. The output beam is split into two parts which are decoded separately using a mask for one beam part and a spatial light modulator for the other beam part.

11 Claims, 5 Drawing Sheets

Three-variable set INTERSECTION operations.

| Resultant Set | Expression |
|---|---|
| (1) | $A \cap \bar{B} \cap \bar{C}$ |
| (2) | $\bar{A} \cap B \cap \bar{C}$ |
| (3) | $\bar{A} \cap \bar{B} \cap C$ |
| (4) | $A \cap B \cap \bar{C}$ |
| (5) | $\bar{A} \cap B \cap C$ |
| (6) | $A \cap \bar{B} \cap C$ |
| (7) | $A \cap B \cap C$ |
| (8) | $\bar{A} \cap \bar{B} \cap \bar{C}$ |

| INPUT | | | | OUTPUT | |
|---|---|---|---|---|---|
| NO. I | A | B | C | SUM | CARRY |
| 1 | 1 | 0 | 0 | 1 | 0 |
| 2 | 0 | 1 | 0 | 1 | 0 |
| 3 | 0 | 0 | 1 | 1 | 0 |
| 4 | 1 | 1 | 0 | 0 | 1 |
| 5 | 0 | 1 | 1 | 0 | 1 |
| 6 | 1 | 0 | 1 | 0 | 1 |
| 7 | 1 | 1 | 1 | 1 | 1 |
| 8 | 0 | 0 | 0 | 0 | 0 |

ULTRAFAST DIGITAL OPTICAL SIGNAL PROCESSING USING A VENN DIAGRAM BASED SPATIAL ENCODING TECHNIQUE

BACKGROUND OF THE INVENTION

The present invention relates generally to digital optical signal processing and more particularly to ultrafast digital optical signal processing using a Venn diagram based spatial encoding technique.

The following is a list of references pertinent to this invention.

1. M. T. Fatechi, K. C. Wasmunt, and S. A. Collins, Jr. Appl. Opt. 20, 2250 (1981).
2. J. Tanida and Y. Ichioka, J. Opt. Soc. Am., 73, 800 (1983).
3. H. Bartelt, A. W. Lohmann, and E. E. Sicre, J. Opt. Soc. Am. A 1, 944 (1984).
4. R. Jin and F. S. T. Yu, Opt. Comm. 65 11 (1988).
5. B. S. Wherrett, Opt. Comm. 56, 87 (1985).
6. P. Z. Peebles, Jr., Probability, Random Variables and Random Signal Principles (McGraw-Hill, New York, 1980) ch. 1.
7. K. M. Johnson, M. A. Handschy, and L. A. (Pagano-Stauffer, Opt. Eng. 26, 385 (1987).
8. R. A. Fisher, ed. Optical Phase Conjugation (Academic Press, New York, 1983).
9. R. A. Fisher, ed. Optical Phase Conjugation (Academic Press, New York, 1983).
9. T. R. O'Meara, D. M. Pepper, and J. O. White, Optical Phase Conjugation, ed. R. A. Fisher, (Academic Press, New York, 1983) ch. 14.
10. P. C. Yeh, Opt. Lett. 12, 138 (1987).
11. Y. Li. G. Eichmann, R. Dorsinville and R. R. Alfano, Appl. Opt. 27, 2025 (1988).
12. A. Yariv, and P. C. Yeh, Optical Waves in Crystals, (John Wiley and Sons, New York, 1983).
13. D. Cotter, Electron, Lett. 22, 693 (1986).
14. L. Yang, Q. Z. Wang, P. P. Ho, R. Dorsinville, and R. R. Alfano, Appl. Phys. Lett. 53, 1245 (1988).
15. U.S. Pat. No. 4,918,635 to Y. Li etc. issued Apr. 17, 1990.

In order to form an optical digital computer, the implementation of an efficient optical binary full-adder is of particular importance. According to one proposed technique which is based on a half-adder approach, a three-input-variable optical full adder is decomposed into two or more two-input-variable optical gates. However, this scheme suffers from problems such as energy and speed loss through cascading, inefficient use of memory and so forth. According to another proposed technique, a single device-based direct optical full-adder implementation is utilized. Optical bistability is used to generate both sum and carry outputs from the three input bits to be added. However, because of direct counting of input power levels in an analog threshold operation the device output precision is strongly affected by the accuracy of input power levels as in the case of all analog devices. Still another proposed full-adder implementation approach suggests a polarization shadow casting scheme that allows for the simultaneous processing of all three input variables. The problem with this approach is the lack of an efficient real-time input encoding scheme.

From the above it can be concluded that an efficient optical full-adder requires that the following conditions should be satisfied:

1. All three input variables should be identically processed with the same nonlinear optical effect to reduce the possible scale mismatch of the device nonlinearities;
2. A serial connection of several optical gates should not be used unless the long existing problem of additional power and speed loss through device cascading can be solved;
3. A digital processing of all three variables should be performed so as to retain the computation accuracy; and
4. A real-time input encoding scheme must be used to possess an overall fast processing speed.

Accordingly, it is an object of this invention to provide a new and improved ultrafast digital optical signal processor.

It is another object of this invention to provide a new and improved ultrafast digital optical full adder.

It is still another object of this invention to provide a new and improved bit-serial opto-electronic central processing unit.

SUMMARY OF THE INVENTION

In one embodiment of the invention, which constitutes a binary full adder, an optical phase conjugating device is encoded using a Venn diagram based spatial encoding scheme. More specifically, the three input beams of the optical phase conjugator are encoded according to a three input set Venn diagram encoding scheme using three voltage controlled spatial light modulators. The output beam produced by the optical phase conjugator is split into two parts. Each part is then decoded separately using specially shaped masks, one for providing sum information and the other for providing carry information.

In another embodiment of the invention, which is intended to serve as a bit-serial central processing unit (CPU), the three beams of an optical phase conjugator are encoded according to a Venn diagram encoding scheme using the voltage controlled spatial light modulation. One part of the output beam produced by the optical phase conjugator is decoded using a mask while the other part is decoded using a voltage controlled spatial light modulator. The part of the output beam decoded by the mask is used to control the input to the voltage controlled spatial light modulation in the other output part as well as the voltage controlled spatial light modulator used with one of the input beams.

In a third embodiment of the invention, also useful as a binary full adder, a single beam is encoded according to a three set Venn diagram using three voltage controlled spatial light modulators disposed along the beam path. The resulting beam is then split into two parts, each of which is decoded separately.

Various features and advantages will appear from the description to follow. In the description, reference is made to the accompanying drawing which forms a part thereof, and in which is shown by way of illustration, specific embodiments for practicing the invention. These embodiments will be described in sufficient detail to enable those skilled in the art to practice the invention, and it is to be understood that other embodiments may be utilized and that structural change may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals.

DETAILED DESCRIPTION OF PREFERRED EMBODIMENTS

The present invention is directed to the idea of using a Venn diagram based spatial encoding technique as the basis for performing ultrafast digital optical signal processor.

As is known, a Venn diagram is a geometrical representation of a Set theory commonly used in algebra. The basic elements in a two dimensional Venn diagram are a sample space S and a number of sets, the particular number of sets being a matter of choice, each set being represented by an isolated area of a desired shape located at a specified position in the sample space. The complement of a set A is a new set defined as $\overline{A}$ which is equal S−A and is denoted by the area outside A in S. For a given Venn diagram two useful set operations are the INTERSECTION and UNION denoted as "∩" and "∪", respectively. While the result of INTERSECTION of some sets generates a new set represented by a resultant common area (if existed) of all involved events, the UNION of these events results in a second new set that includes all the involved areas.

Figures 1, 2:
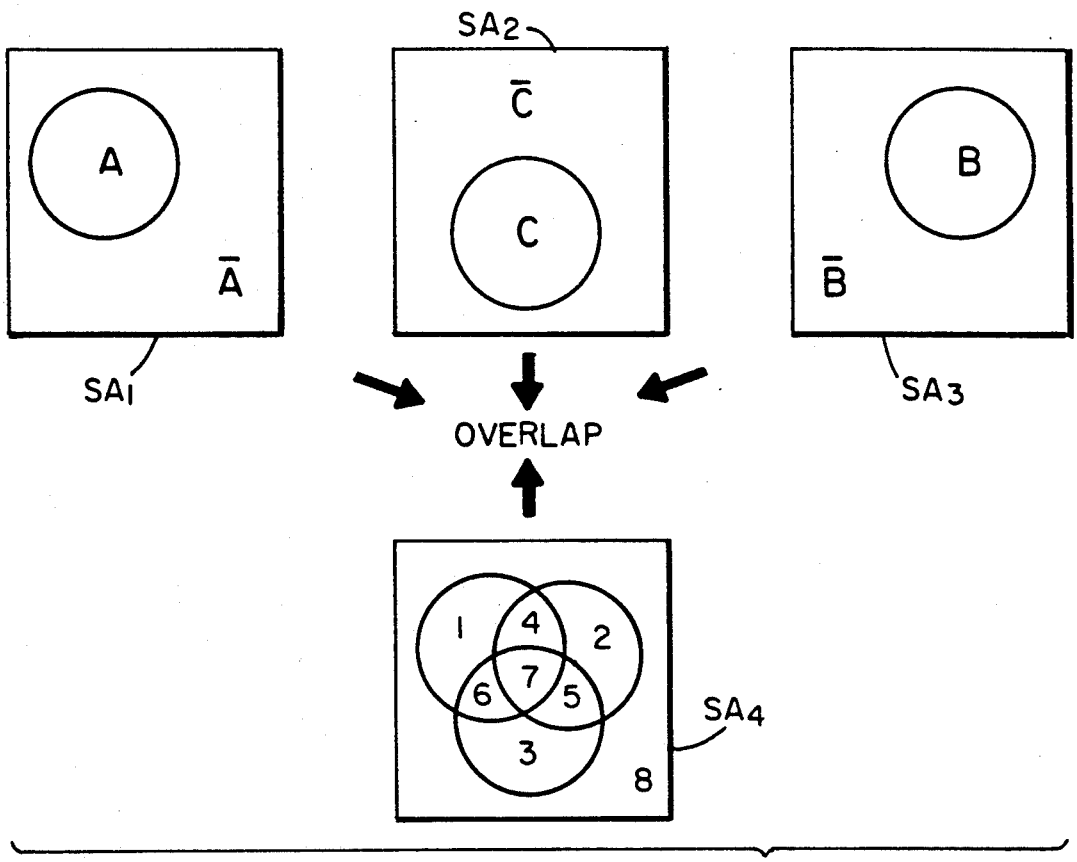
FIG. 1 is an illustration of a three-input set Venn diagram.
FIG. 2 is a table based on the INTERSECTION operation for the eight resulting regions show in the Venn diagram in FIG. 1.

An example of a three-input set Venn diagram is shown in FIG. 1. As can be seen, the three variables A, B and C are represented by three circular areas positioned at different locations in equally sized square areas $SA_1$, $SA_2$ and $SA_3$. The areas outside of the circular regions in the square areas $SA_1$, $SA_2$ and $SA_3$ are used for the complements of the three variables denoted A, B and C, the complements being identified as $\overline{A}$, $\overline{B}$ and $\overline{C}$. For a binary full-adder implementation, these three variables can be used to represent the two external input and an intermediate carry input variables. With this three-variable encoding scheme, a complete Venn diagram is shown in the square area $SA_4$ at the bottom of FIG. 1. As can be seen, the square space $SA_4$ at the bottom of FIG. 1 is divided into eight regions (i.e. possible output sets) labelled from 1 to 8. In the table shown in FIG. 2, interpretations of these eight resultant regions are provided, based on the INTERSECTION operation. By means of a UNION operation on these resultant sets, the adder's sum $S^1$ and carry output $C^1$ can be written as $S^1=[1]\cup[2]\cup[3]\cup[7]$ and $C^1=[4]\cup[5]\cup[6]\cup[7]$ where [i] denotes the $i^{th}$ INTERSECTION set in Table 1. Geometrically, $S^1$ corresponds to points in any of the 1, 2, 3, 7 areas and $C^1$ corresponds to points in any of the 4, 5, 6, 7 areas.

An optical phase-conjugator (OPC) is a well known device that uses two on-axis counterpropagating beams and a third off-axis beam inside a third-order ($X^{(3)}$) nonlinear optical material (NLM) to generate an output beam that counterpropagates with respect to the off-axis input.

Figures 3, 4, 6:
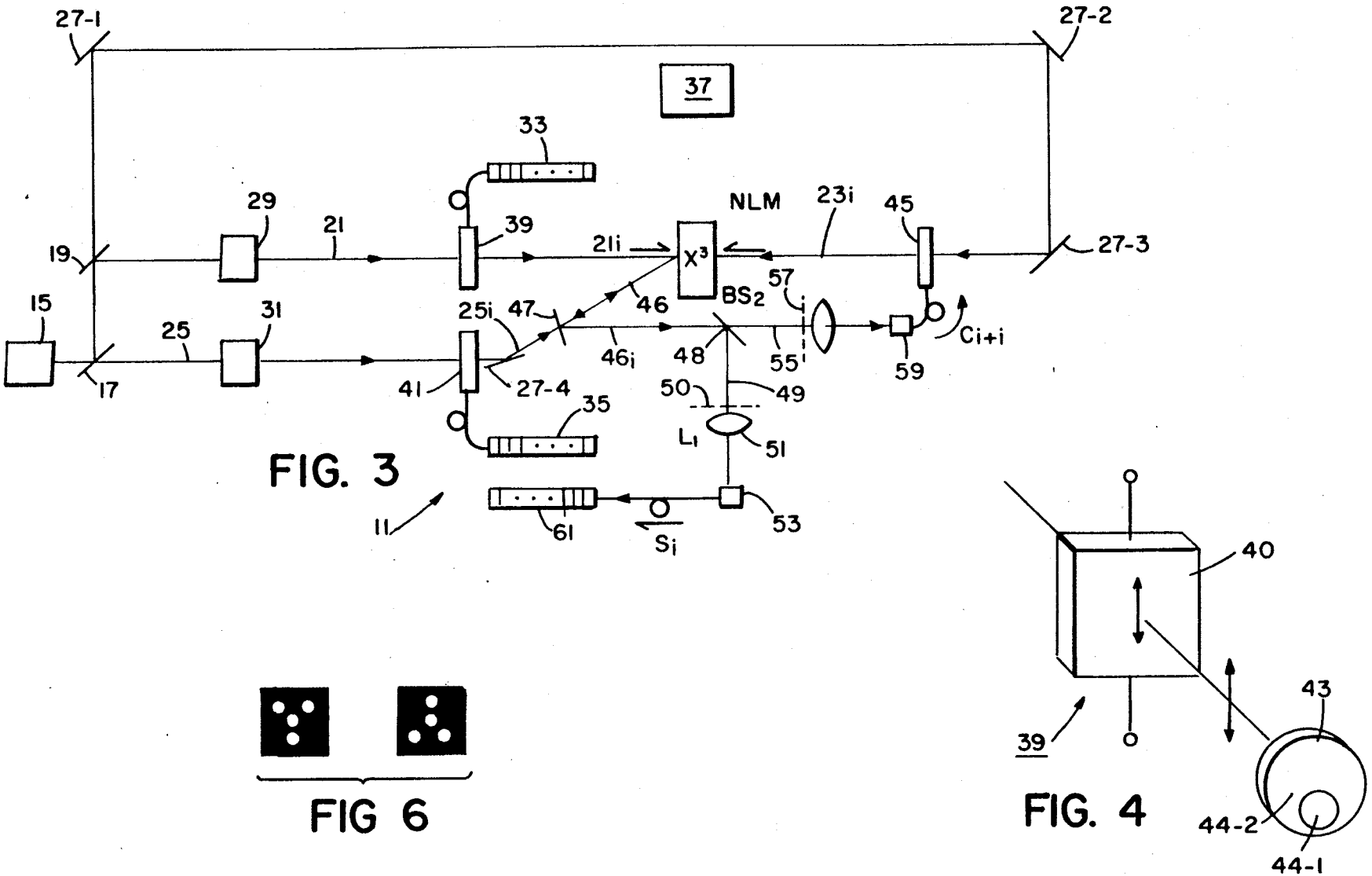
FIG. 3 is a schematic of an optical binary full adder according to this invention.
FIG. 4 is a schematic of one of the variable spatial light modulators shown in FIG. 3.
FIG. 6 is a plan view of the two masks shown in FIG. 3.

Referring now to FIG. 3 there is shown a binary optical full-adder 11 constructed according to this invention.

Full adder 11 includes a body 13 of a third order nonlinear material ($X^{(3)}$). Examples of third order nonlinear material are cadmium selenide, glass, polymers and liquid crystals. A beam of light from an ultrafast pulse light source 15, such as a mode locked YAG laser, is split by a pair of beamsplitters 17 and 19 into three input beams 21, 23 and 25. Beam 21 is directed into nonlinear medium 13 on-axis. Beam 23 is deflected off mirrors 27-1, 27-2 and 27-3 into nonlinear medium 13 on-axis and copropogating with respect to beam 21. Beam 25 is deflected off a mirror 27-4 into nonlinear medium 13 off-axis. Optical delays 29 and 31 are provided along beam paths 21 and 25 respectively, so that beams 21 and 23 and 25 arrive at nonlinear medium 13 at the same time (i.e. are coherent). As can be appreciated, input beams 21, 23 and 25 along with NLM 13 and an output beam hereinafter described constitute an optical phase conjugator.

Two N-bit binary input strings which are to be added by full adder 11 are stored in electronic registers 33 and 35 which are coupled to and controlled by a computer 37. For simplicity, the connections to computer 37 are not shown.

The outputs of registers 33 and 35 are fed into real time encoding spatial light modulators (SLM) 39 and 41 which are disposed along the paths of beams 21 and 25 respectively.

SLM's 39 and 41 each comprises an active λ/2 plate which is positioned in front of a composite polarization mask. One of the SLM's, namely, SLM 39 is shown in FIG. 4. As can be seen, SLM 39 comprises a voltage controlled optical wave retardation plate 4a which is positioned in front of a composite polarization mask 43. Composite polarization mask 43 contains two orthogonal linear polarizers 44-1 and 44-2 of the shaped specified for a particular Venn diagram input variable set and its complement. In the mask shown in FIG. 4, the polarizers 44-1 and 44-2 correspond in shape to the A and $\overline{A}$ set, respectively shown in the left top of FIG. 1. SLM 41 differs from SLM 39 in that its two polarizers correspond in shape to the B and $\overline{B}$ set shown at the top right in FIG. 1 rather than the A, $\overline{A}$ set. Active wave retardation plate 41 switches the optical signal between its two orthogonal linear polarizations so that when the switched signal is incident on composite polarization mask 43, its transmission at either one of the two polarizations masks 44-1 and 44-2 will be totally blocked.

Recent research on ferroelectric liquid crystal material has indicated that a potential polarization switching frame-rate in access of MHz can be reached using such a spatial light modulation.

The encoded signals produced by SLM's 39 and 41 are carried by coherent input beams 21 and 25 into body 13 of nonlinear material (NLM) from the left-hand side as shown in the figure. A third spatial light modulator (SLM) 45 is disposed along the path of beam 23. SLM 45 differs from SLM 39 in that its two polarizers correspond in shape to the C and $\overline{C}$ set shown at the top center in FIG. 1 rather than the A, $\overline{A}$ set.

To add the two input binary numbers in registers 33 and 35, initially, the right-hand side input optical beam 23 is encoded with C pattern (See FIG. 1) for a zero carry input. In FIG. 3, $21_i$, $23_i$ and $25_i$ are the three simultaneously arriving pulses of beams 21, 23 and 25 representing the $i^{th}$ digits of the two external input strings and the carry input string. The simultaneous arrival of the three input pulses at NLM 13 generates an INTERSECTION pattern carried out by output beam 46. Beam 46 which copropagates with respect to beam $21_i$ is deflected off a beamsplitter 47. To form the sum and carry outputs, output beam 46 is further split into two parts by another beamsplitter 48.

Figures 5, 9:
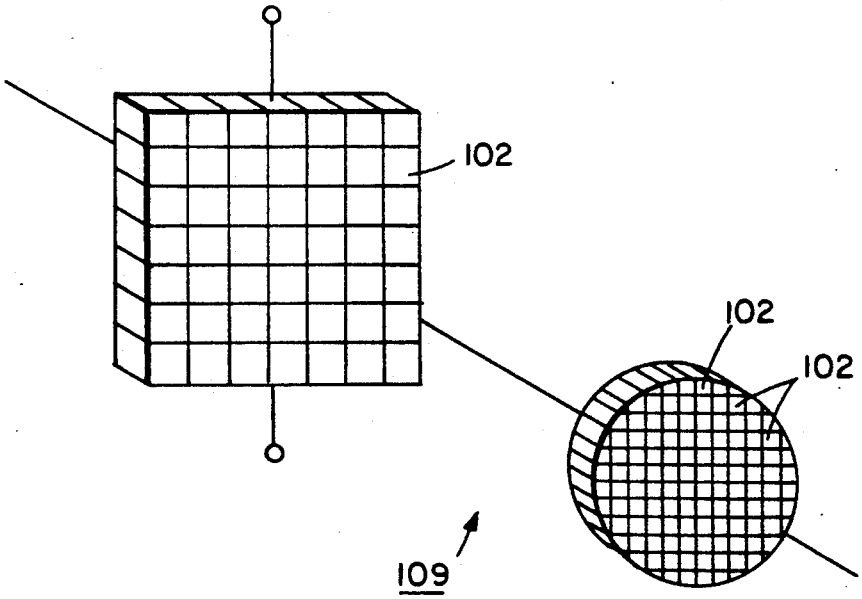
FIG. 5 is a table useful in understanding the operation of this invention.
FIG. 9 is a schematic view of variable spatial light modulator 109 shown in FIG. 8.

A truth table showing the sum and carry output possibilities that are obtained from three binary inputs A, B and C is illustrated in FIG. 5.

The reflected beam part 49 is passed through a two dimensional mask 50 and then brought to focus by a lens 51 at a detector 53. Detector 53 may comprise a photomultiplier tube transmittal beam 55 is passed through another two dimensional mask 57 and then brought to focus by a lens 58 at a detector 59 which may also be a photomultiplier tube. The two masks 50 and 57 are designed each with four holes positioned to collect optical signals appearing in the Venn diagram regions 1, 2, 3, 7 and 4, 5, 6, 7, respectively. The two masks 50 and 57 are shown in FIG. 6. In mask 50 the holes are identified by reference numerals 50-1 and in mask 57 the holes are identified by reference numerals 57-1. At the focal planes of the two lenses 51 and 58, the required UNION operations on these regions are obtained.

Detectors 53 and 59 disposed at the focal planes of lenses 51 and 58 are used to convert optical signals (bright or dark) into their binary voltage pulses. The output from detector 51 is stored in an output register 61 as part of the addition result. The output from detector 59 is used to trigger the next state carry bit encoder, i.e. SLM 45, for the next bit pair addition. Detectors 53 and 59 may comprise photomultiplier tubes.

Because of using the above described polarization encoding, an OPC-based set INTERSECTION operation on three x and y polarized input beams is required. This requirement can be satisfied when an isotropic NLM that possesses all three $X^{(3)}$ components, e.g. xxxx, xyyx, and xyxy, is used. In this case, when the three input beams are turned on independently of their polarization states, an output signal is generated.

Figure 7:
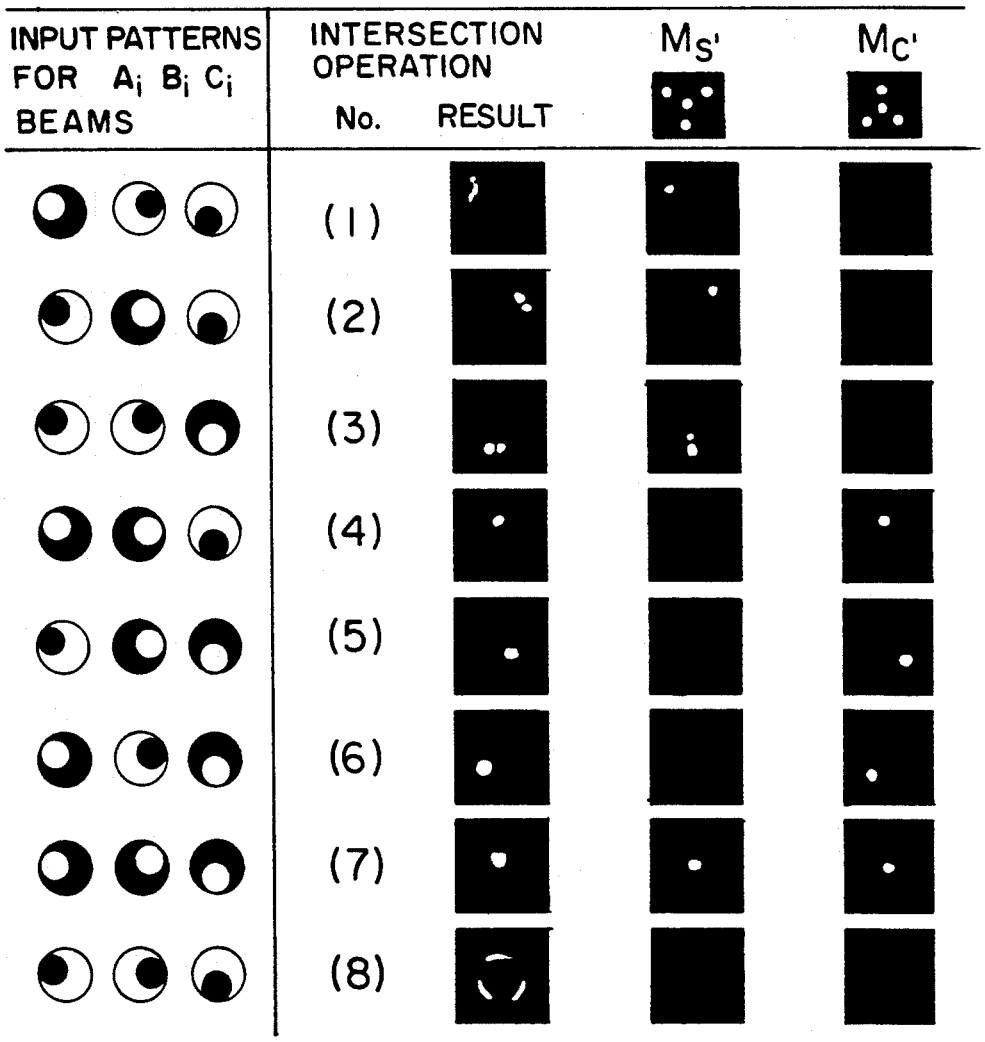
FIG. 7 is a table showing experimental results of a full adder actually constructed and tested.

In an embodiment of a full adder actually constructed a Quantel mode-locked $Nd:_{3+}YAG$ laser which generates a train of 10 Hz 32 ps 1064 nm pulses was used as a light source. Using a KDP crystal, the infrared laser beam was converted into 532 nm (so as to be in the visible portion of the spectrum) which was then spatially magnified to a circular beam profile with 1.5 cm in diameter. The body of nonlinear material was a commercially available 2.54 cm×2.54 cm, 2 mm- thick 3-68 Corning glass filter which consists of microcrystal structures of $Cds_xSe_{1-x}$ ternary compound semiconductors embedded in an amorphous glass matrix. The device was similar to the setup shown in FIG. 3. For encoding the input beams, a set of circular shape polarization masks was employed. The diameters of the circular areas for the sample space S and for each input variable, A, B or C, was 1.1 cm and 0.6 cm, respectively. These input masks were placed in front of half-wave-retardation plates and inserted into the three input beams. By rotating the retardation plates, eight different input variable combinations were obtained. The corresponding light patterns are shown in the first three columns in the table in FIG. 7. The next two columns in the table FIG. 7 show the operation codes and experimental results generated using the inputs. As can be seen, depending on the eight input polarization combinations, the observed signal intensity varies significantly (about ten times difference) with the strongest and weakest signals appearing at combinations 7, 8 and 2, 5, respectively. For the generation of the full-adder's sum and carry output, two grouping masks corresponding to masks 50 and 57 were employed. The masked results for the full-adder's sum and carry outputs are shown in the last two columns of FIG. 7.

Figure 8:
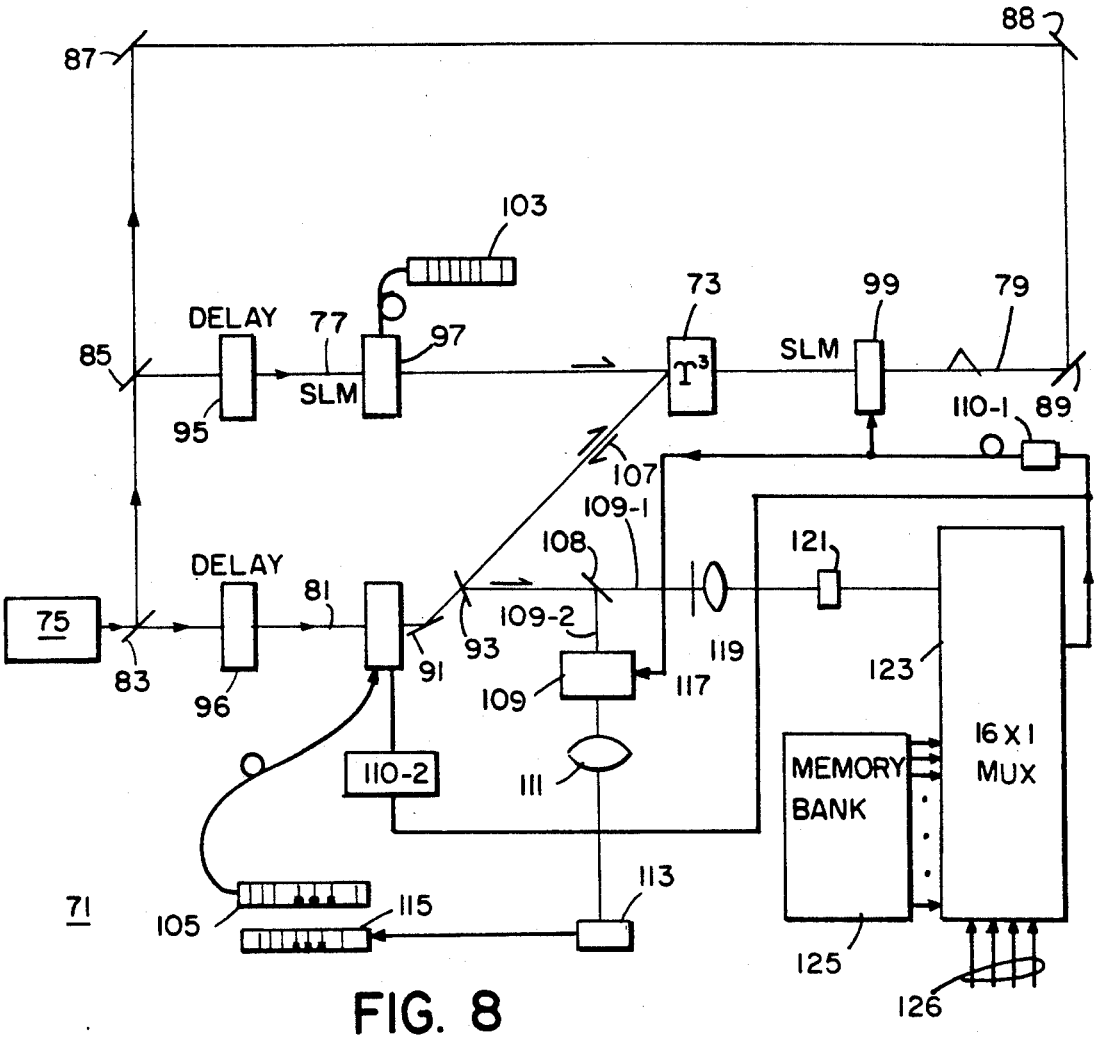
FIG. 8 is a schematic of another system constructed according to this invention.

Referring now to FIG. 8, there is shown a bit-serial opto-electronic CPU 71 constructed according to this invention.

Apparatus 71 includes a body of a third-order nonlinear material 73 and an ultrafast pulse light source 75, such as a mode locked YAG laser, for producing a beam of coherent light. The beam of light from source 75 is split into three beam parts 77, 79 and 81 by a pair of beamsplitters 83 and 85. Beam 77 is directed into medium 73 on-axis. Beam 79 is deflected off mirrors 87, 88 and 89 and then directed into medium 73 on-axis and counter propagating with respect to beam 77. Beam 81 is deflected off a mirror 91, passed through a beamsplitter 93 and directed into medium 73. As can be seen, NLM 73 along with beams 77, 79 and 81 and beam 107 (to be described below) constitute an optical phase conjugator. Delays 95 and 96 are provided so that the three beams 77, 79 and 81 arrive at medium 73 simultaneously. Beams 77 and 79 and 81 are encoded by variable spatial light modulators (SLM) 97, 99 and 101, respectively. SLM's 97 and 101 are identical in construction to SLM 39. Modulators 97 and 101 receive input information from registers 103 and 105 which are controlled by a computer (not shown). The output beam 107 from medium 73 which counterpropogates along the path of beam 81 is reflected off beamsplitter 93, then strikes a beamsplitter 108 where it is split into two parts 109-1 and 109-2. One part 109-2 is modulated by a variable spatial light modulator 109 and then brought to focus by a lens 111 in a detector 113 whose output is stored in an output register 115. SLM 109 each comprises an array of 2/2 retardation plates 102-1 disposed in front of an array of orthogonal linear polarizers 102-2 and 102-3 as shown in FIG. 9. The other part 109-2 is passed through a mask 117 and then brought to focus by a lens 119 in a detector 121 whose output is fed into a 16×1 multiplexer 123. Multiplexer 123 also receives inputs from a memory bank 125 and coded instructions from the computer (not shown) over lines 126. The output of multiplexor 123 is fed into SLM 109 through and address selector 110-1 and into SLM 101 through an address selector 110-2. Address selector 110-1 removes all information except for the first bit while address selector 110-2 passes all information except the first bit.

In the operation of apparatus 71, multiplexor 123, upon the receipt of a 4-bit coded instruction from the computer over lines 126 switches one of its 16 inputs corresponding to a particular Venn diagram to its output which controls SLM's 99 and 109. The output pattern which is the multiplication of three input Venn diagram patterns is generated in output beam 107. Depending on the signal combination at the four coded instruction input lines 104, the MUX 123 selects one of its 16 input signals either from the feed-back 124 or from parallel memory bank 125 that stores all the required reference pattern signals. The output from the MUX 123 controls both SLM 97 and SLM 109 which determine the particular operation to be performed. For example, for both the two-variable logic and transfer operations, the two input variables enter the processor from beams 77 and 81 while the operation control kernel enters from SLM 109. In this case, SLM 97 simply passes the full aperture beam (no Venn diagram is needed), while for the arithmetic operations such as a full addition or subtraction where a carry variable is needed, beam 79 is used to carry the carry variable feed-back from the previous cycle addition or subtraction.

Bit-serial CPU 71 can process 16 different either logic or arithmetic operations. The selection of these operations is at the control for the operator and depends on the application.

By combining a set of identical bit-serial CPUs, a parallel word-parallel multi bit CPU can be realized.

Figure 10:
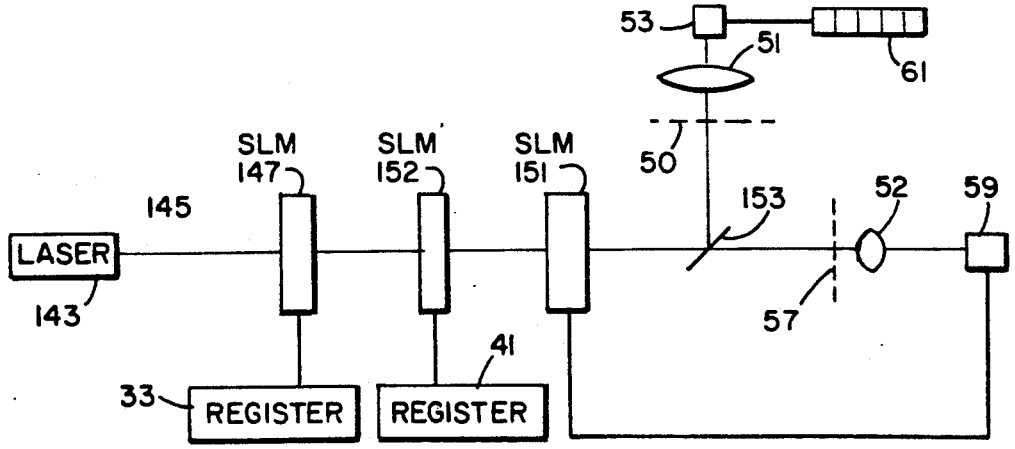
FIG. 10 is a schematic of another embodiment of the invention.

Referring now to FIG. 10 there is shown another embodiment of the invention identified by reference numeral 141.

System 141 includes a laser 143 for generating a beam of light 145. Three SLM's 147, 149 and 151 are disposed along the path of beam 145 for intensity modulating beam 145, each according to a different one of three sets of a three set Venn diagram. SLM's 147 and 149 receive information from registers 33 and 41, respectively. Each SLM 147, 149 and 151 comprises a self Electro Optical Effect Device (SEED). The resulting beam is split into two parts by a beamsplitter 153. One part is passed through a mask 50 and then brought to focus by a lens 51 on a detector 53 whose output is fed into an output register 61. The other part is passed through a mask 57 and then brought to focus by a lens 52 onto a detector 59 whose output is fed into SLM 151.

The embodiments of the present invention is intended to be merely exemplary and those skilled in the art shall be able to make numerous variations and modifications to it without departing from the spirit of the present invention. For example in the FIG. 10 embodiment a Venn diagram arrangement of more than three sets can be employed. All such variations and modifications are intended to be without the scope of the present invention as defined in the appended claims.

What is claimed is:

1. A method of adding two binary numbers optically comprising:

a. providing a body of a third order nonlinear medium;

b. providing three coherent beams of light;

c. encoding each beam using a different set of a three set Venn diagram encoding scheme, one of the beams being encoded with one of the numbers to be added, another beam with the other number and the third beam with carry information;

d. directing the three encoded beams into said third order nonlinear medium simultaneously, two on axis and one off axis, so as to produce an off-axis output beam;

e. splitting the output beam into two parts, and f. decoding each output beam part to produce sum and carry information.

2. Apparatus for adding two binary numbers optically comprising:

a. a body of a third order nonlinear medium;

b. means for providing three coherent beams of light;

c. means for encoding one of the beams of coherent light with one of the binary numbers, another beam of coherent light with the other binary number and the third beam of coherent light with carry information using a mathematical set theory and a Venn diagram encoding scheme;

d. means for directing the three encoded beams of coherent light into said third order nonlinear medium, two on axis and one off axis, so as to produce an off-axis output beam of light;

e. means for splitting the output beam of light into two parts, and f. means for decoding each part of said output beam of light to produce sum and carry information.

3. The apparatus of claim 2 and wherein the means for providing three coherent beams of light includes a laser.

4. The apparatus of claim 2 and wherein the means for encoding the three beams comprises three voltage controlled spatial light modulator.

5. The apparatus of claim 4 and wherein each voltage controlled spatial light modultor comprises a half wave plate and a composite polarization mask.

6. The apparatus of claim 5 and wherein the decoding means comprises a pair of mask.

7. The apparatus of claim 5 and further including means for holding the two binary numbers to be added and the resulting sum information.

8. A bit serial central processing unit comprising:

a. a body of a third order nonlinear medium;

b. means for providing three coherent input beams of light, c. means for directing said three coherent beams of light into said third order nonlinear medium, two on axis and one off axis, so as to produce an off-axis output beam;

d. delays means for delaying two of said coherent input beams of light so that all three coherent beams of light arrive at the third order nonlinear medium simultaneously;

e. separate encoding means for encoding each one of said three input beams of coherent light before entering said third order nonlinear medium;

f. means for splitting the off-axis output beam into first and second beam parts, g. a mask disposed along the path of the second beam part of the output beam, h. a first detector for detecting light passed by the mask, i. an output spatial light modulator for receiving the first output beam part and a signal from the detector;

j. a second detector for converting the output of the output spatial light modulator into an electrical output, and k. means for storing the electrical output.

9. A method of adding two binary numbers comprising:

a. providing a beam of light;

b. encoding the beam of light using three spatial light modulator, each spatial light modulator encoding the beam of light according to a different one of a three set Venn diagram;

c. splitting the encoded beam into two parts using a beamsplitter, d. decoding each output beam part to produce sum and carry information;

e. recording the sum information; and f. feeding the carry information back into one of said spatial light modulator.

10. Apparatus for adding two binary numbers optically comprising:

a. means for providing a beam of light;

b. means for encoding the beam using three spatial light modulators, each spatial light modulator encoding the beam of light according to a different one of a three set Venn diagram;

c. beamsplitting means for splitting the encoded beam into two parts, and d. means for decoding each output beam part to produce sum and carry information.

11. The apparatus of claim 10 and wherein spatial light modulators are polarization type spatial light modulators.

* * * * *